US009109450B2

(12) United States Patent
Hummel et al.

(10) Patent No.: US 9,109,450 B2
(45) Date of Patent: Aug. 18, 2015

(54) ROTOR ASSEMBLY WITH INTERLOCKING TABS

(75) Inventors: Raymond S. Hummel, South Windsor, CT (US); Matthew P. Ricker, Reno, NV (US); Scott D. Virkler, Ellington, CT (US); Virginia L. Ross, Madison, WI (US)

(73) Assignee: United Technologies Corporation, Hartford, CT (US)

( * ) Notice: Subject to any disclaimer, the term of this patent is extended or adjusted under 35 U.S.C. 154(b) by 560 days.

(21) Appl. No.: 13/523,272

(22) Filed: Jun. 14, 2012

(65) Prior Publication Data

US 2013/0336785 A1 Dec. 19, 2013

(51) Int. Cl.
*F01D 1/04* (2006.01)
*F01D 5/06* (2006.01)

(52) U.S. Cl.
CPC ..... *F01D 5/066* (2013.01); *Y10T 29/49336* (2015.01)

(58) Field of Classification Search
CPC ..... F01D 1/24; F01D 1/22; F01D 5/066; F01D 5/32; F01D 5/30
USPC ..... 416/198 A, 198 R, 244 A, 244 R
See application file for complete search history.

(56) References Cited

U.S. PATENT DOCUMENTS

| | | | | |
|---|---|---|---|---|
| 3,356,339 | A | 12/1967 | Thomas et al. | |
| 3,581,851 | A | 6/1971 | Hall | |
| 3,768,924 | A | 10/1973 | Corsmeier et al. | |
| 4,400,137 | A | 8/1983 | Miller et al. | |
| 5,052,891 | A | 10/1991 | Burkholder | |
| 5,320,488 | A * | 6/1994 | Meade et al. | 415/173.7 |
| 6,443,699 | B1 | 9/2002 | Mashey | |
| 6,481,917 | B1 | 11/2002 | Chen et al. | |
| 7,540,713 | B1 | 6/2009 | Marussich | |
| 2004/0040314 | A1 * | 3/2004 | Isobe et al. | 60/805 |
| 2007/0144172 | A1 | 6/2007 | Sumser et al. | |
| 2008/0008582 | A1 | 1/2008 | Pickens et al. | |
| 2011/0135480 | A1 | 6/2011 | Drmic | |

OTHER PUBLICATIONS

International Search Report for International Application No. PCT/US2013/043215 completed on Sep. 3, 2013.
International Preliminary Report on Patentability for PCT Application No. PCT/US2013/043215 mailed Dec. 24, 2014.

* cited by examiner

*Primary Examiner* — Edward Look
*Assistant Examiner* — Maxime Adjagbe
(74) *Attorney, Agent, or Firm* — Carlson, Gaskey & Olds, P.C.

(57) ABSTRACT

A rotor assembly includes a first rotor having first tabs and a second rotor that is arranged coaxial with the first rotor and that includes second tabs that are interlocked with the first tabs. A retainer locks the first tabs and the second tabs together.

20 Claims, 2 Drawing Sheets

ROTOR ASSEMBLY WITH INTERLOCKING TABS

BACKGROUND

This disclosure relates to improvements in coupling rotors together.

Turbomachines, such as gas turbine engines, typically include a compressor section and a turbine section that is coupled for rotation with the compressor section. The compressor section may include one or more stages of compressor rotors and the turbine section likewise may include one or more stages of turbine rotors. One or more of the compressor rotors can be axially held together with one or more of the turbine rotors using a tie rod, for example. However, if the tie rod connection is lost, one or more of the rotors could move axially, resulting in an over speed condition.

SUMMARY

A rotor assembly according to an exemplary aspect of the present disclosure includes a first rotor including first tabs, a second rotor arranged coaxially with the first rotor which includes second tabs that are interlocked with the first tabs, and a retainer locking the first tabs and the second tabs together.

In a further non-limiting embodiment, each of the first tabs and each of the second tabs includes a base and a free end and extends radially inwardly from the base to the free end.

In a further non-limiting embodiment of any of the foregoing examples, the first tabs and the second tabs define a circumferential channel.

In a further non-limiting embodiment of any of the foregoing examples, the circumferential channel opens in a radially inward direction.

In a further non-limiting embodiment of any of the foregoing examples, the retainer is located in the circumferential channel.

In a further non-limiting embodiment of any of the foregoing examples, the retainer is a split ring.

In a further non-limiting embodiment of any of the foregoing examples, the retainer is a positive engagement member.

In a further non-limiting embodiment of any of the foregoing examples, the positive engagement member is a split ring.

In a further non-limiting embodiment of any of the foregoing examples, the split ring includes radially inwardly projecting hooks.

In a further non-limiting embodiment of any of the foregoing examples, the first rotor and the second rotor each include a number (N) of airfoils, and the first rotor and the second rotor each include a number (T) of, respectively, the first tabs and the second tabs such that N is a positive integer multiple of T.

In a further non-limiting embodiment of any of the foregoing examples, the positive integer multiple is 2.

In a further non-limiting embodiment of any of the foregoing examples, the second tabs are circumferentially interlocked with the first tabs.

In a further non-limiting embodiment of any of the foregoing examples, the first rotor includes a first projection extending axially and located radially outwards of the first tabs and the second rotor includes a second projection extending axially and located radially outwards of the second tabs, the second projection axially overlapping the first projection and radially bearing against the first projection.

A turbomachine according to an exemplary aspect of the present disclosure includes a compressor section and a turbine section coupled to rotate with the compressor section. The turbine section includes a first rotor having first tabs, a second rotor arranged coaxially with the first rotor and having second tabs that are interlocked with the first tabs, and a retainer coupling the first tabs and the second tabs together.

In a further non-limiting embodiment of any of the foregoing examples, each of the first tabs and each of the second tabs include a base and a free end and extends radially inwardly from the base to the free end.

In a further non-limiting embodiment of any of the foregoing examples, the first tabs and the second tabs define a circumferential channel that opens in a radially inward direction, and the retainer is located in the circumferential channel.

In a further non-limiting embodiment of any of the foregoing examples, the compressor section includes a compressor rotor, and the compressor rotor, the first rotor and the second rotor are axially held together by a tie rod.

A method of coupling a first rotor and a second rotor together according to an exemplary aspect of the present disclosure includes interlocking first tabs of a first rotor with second tabs of a second rotor that is arranged coaxially with the first rotor and locking the first tabs and the second tabs together using a retainer.

In a further non-limiting embodiment of any of the foregoing examples, the interlocking of the first tabs with the second tabs includes establishing a circumferential channel that opens in a radially inward direction.

In a further non-limiting embodiment of any of the foregoing examples, the locking of the first tabs and the second tabs together includes inserting the retainer into the circumferential channel.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
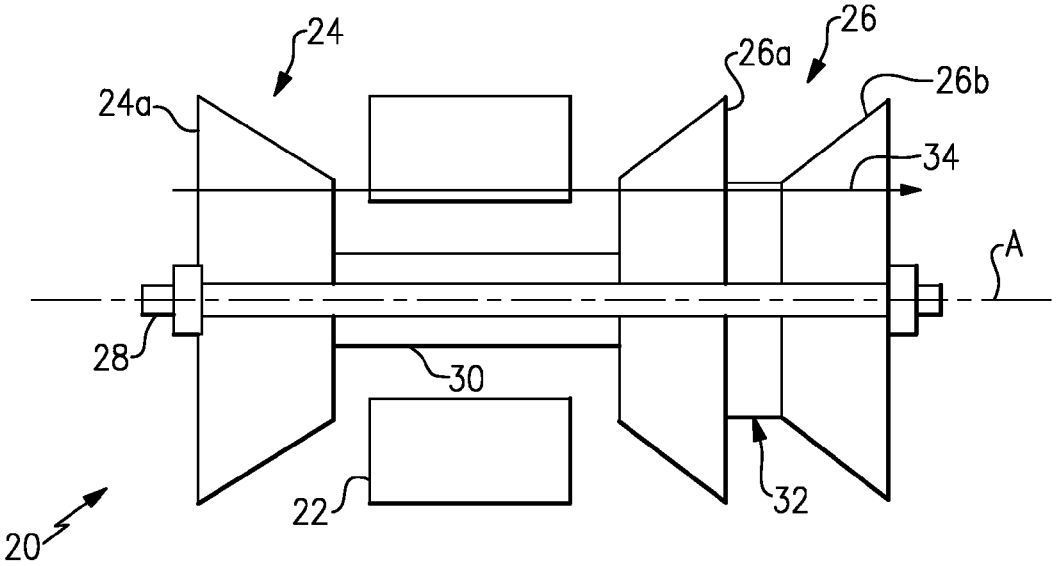
FIG. 1 illustrates an example turbomachine.

FIG. 1 schematically illustrates a turbomachine 20. In this example, the turbomachine 20 is a gas turbine engine and thus includes a combustor 22. However, it is to be understood that this disclosure is not limited to gas turbine engines and that the examples described herein are applicable to other types of gas turbine engines and turbomachinery that may not include the combustor 22.

The turbomachine 20 generally includes a compressor section 24 having a compressor rotor 24*a* and a turbine section 26 having a first rotor 26*a* and a second rotor 26*b*. For example, the first rotor 26*a* and the second rotor 26*b* are considered to be two stages of the turbine section 26, such as high pressure turbine stages of a gas turbine engine.

A tie rod 28 axially holds the compressor rotor 24*a*, the first rotor 26*a* and the second rotor 26*b* together. The compressor rotor 24*a* and the first rotor 26*a* are mounted on a common shaft 30 such that the first rotor 26*a* and the compressor rotor 24*a* are rotatable in unison. The second rotor 26*b* is coupled for rotation with the first rotor 26*a* through a locking mechanism 32, which is shown schematically in FIG. 1.

The operation of the turbomachine 20 is generally known and is represented by the flow path 34 there through. The compressor section 24 compresses air and communicates the compressed air into the combustor 22. The compressed air is mixed and burned with fuel in the combustor 22, then expanded over the turbine section 26. It is to be understood that the turbomachine 20 is shown highly schematically and may include additional compression stages and additional turbine stages, as well as a fan, for example.

Figure 2:
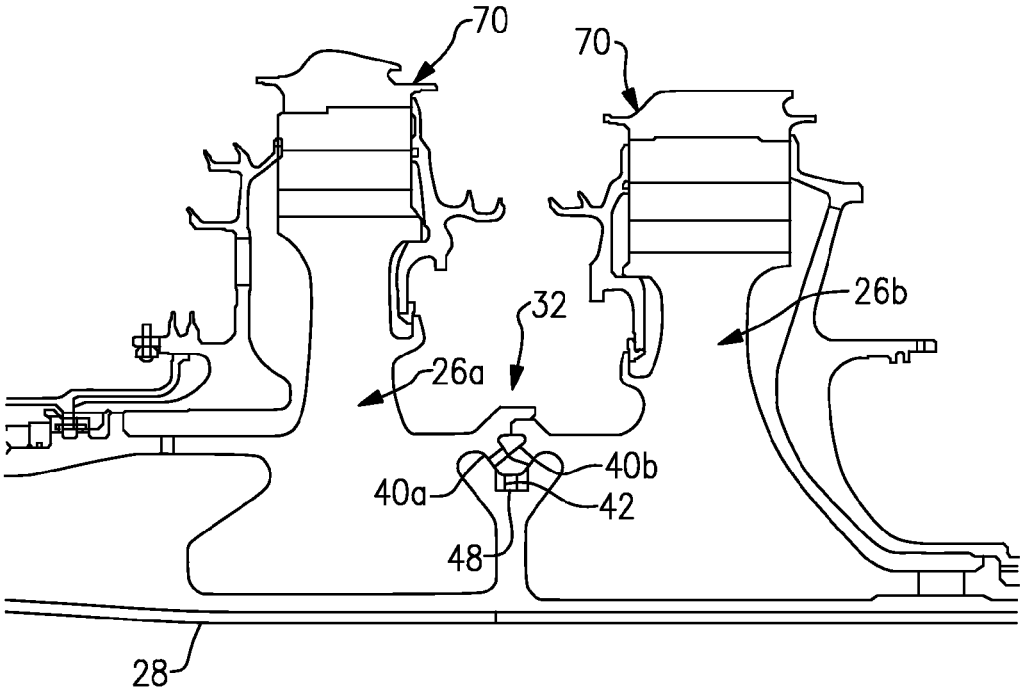
FIG. 2 shows an expanded view of a first rotor, a second rotor and locking mechanism coupling the first rotor and the second rotor together.
Figure 3:
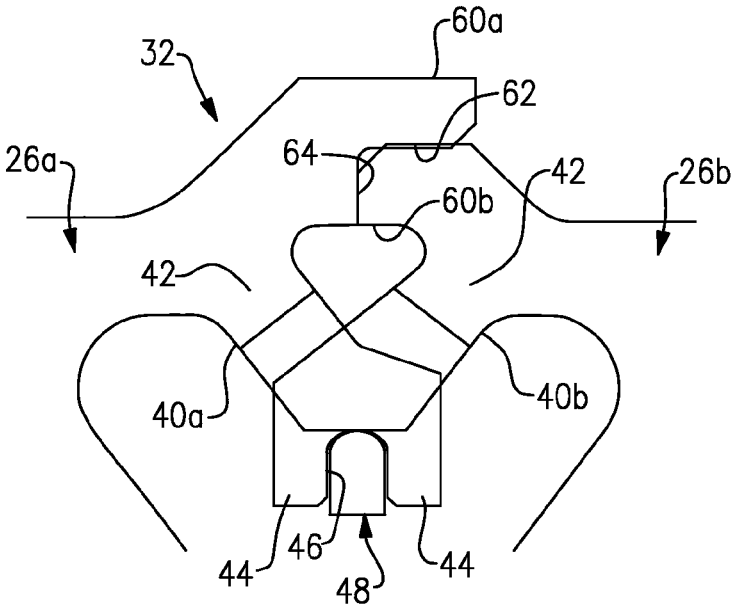
FIG. 3 shows an expanded view of the locking mechanism of FIG. 2.
Figure 4:
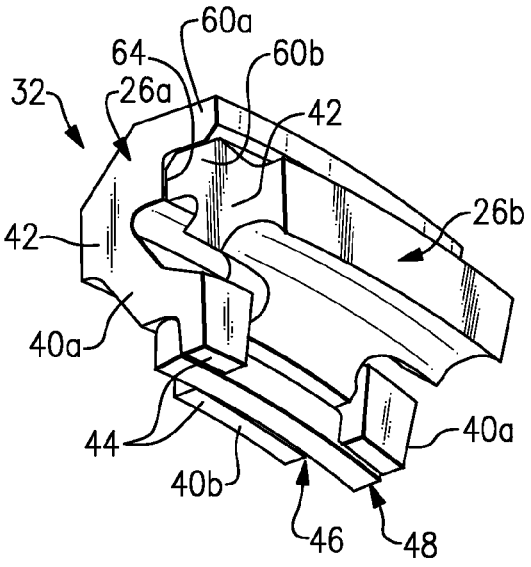
FIG. 4 illustrates an expanded perspective view of the locking mechanism of FIG. 2.

FIG. 2 shows an expanded view of the first rotor 26*a*, the second rotor 26*b* and the locking mechanism 32. FIG. 3 shows an expanded view of the locking mechanism 32 and FIG. 4 shows a perspective view of a portion of the locking mechanism 32. Referring to FIGS. 2-4, the first rotor 26*a* includes a first tabs 40*a* and the second rotor 26*b* includes second tabs 40*b* that are interlocked with the first tabs 40*a*. That is, the first tabs 40*a* of the first rotor 26*a* are circumferentially arranged such that each tab 40*a* is circumferentially spaced from its neighboring first tabs 40*a*. Likewise, the second tabs 40*b* are circumferentially arranged such that each of the second tabs 40*b* is circumferentially spaced from its neighboring second tabs 40*b*. Thus, when the rotors 26*a*/26*b* are assembled into coaxial arrangement, the tabs 40*a*/40*b* circumferentially interlock such that the rotors 26*a*/26*b* are rotatable in unison.

The tabs 40*a*/40*b* extends both axially and radially from the respective rotors 26*a*/26*b*. Thus, the first tabs 40*a* extend axially rearwardly from the first rotor 26*a* and the second tabs extend axially forwardly from the second rotor 26*b*. Each of the first tabs 40*a* and each of the second tabs 40*b* include a base 42 and a free end 44 such that each of the tabs 40*a*/40*b* extends radially inwardly from the respective base 42 toward the free end 44.

When interlocked, the first tabs 40*a* and the second tabs 40*b* define a circumferential channel 46. A retainer 48 is located in the circumferential channel 46 to lock the first tabs 40*a* and the second tabs 40*b* together. Thus, the first rotor 26*a* and the second rotor 26*b* are coupled together for co-rotation through the locking mechanism 32. In other words, the interlocking of the first tabs 40*a* and the second tabs 40*b* circumferentially and rotationally locks the first rotor 26*a* and the second rotor 26*b* together. The retainer 48 within the circumferential channel 46 defined by the first tabs 40*a* and the second tabs 40*b* prevents or limits relative axial movement between the first rotor 26*a* and the second rotor 26*b*. Thus, the rotors 26*a*/26*b* are rotationally and axially coupled together. The rotational and axial coupling of the first rotor 26*a* and the second rotor 26*b* ensures that the second rotor 26*b* will not axially disengage from the first rotor 26*a* in the case that the connection provided by the tie rod 28 is lost. Furthermore, the locking mechanism is compact and can be used as a design replacement where packaging considerations do not permit other bolted or other types of locking designs.

To further facilitate coupling of the rotors 26*a*/26*b*, the first rotor 26*a* includes an axial projection 60*a* and the second rotor 26*b* includes an axial projection 60*b*. The axial projections 60*a*/60*b* axially overlap and radially bear against one another at bearing surface 62. A thrust bearing surface 64 reacts axial loads and acts as an axial stop in assembling the rotors 26*a*/26*b* together. In operation, friction at the bearing surfaces 62 and 64 limits relative rotational and axial movement between the rotors 26*a*/26*b*.

Figure 5:
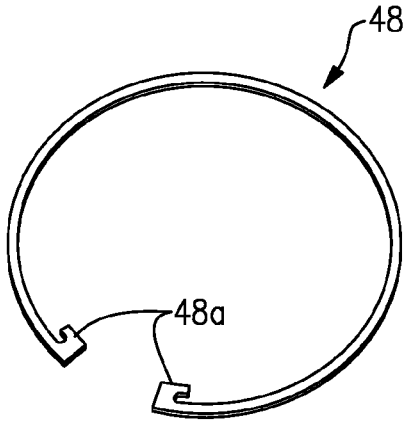
FIG. 5 shows an isolated view of a retainer.

FIG. 5 shows an isolated full view of the retainer 48. In this example, the retainer 48 is a split ring, which is also considered to be a positive engagement member. In the uncompressed state shown in FIG. 5, the retainer 48 is diametrically larger than the circumferential channel 46 defined by the first tabs 40*a* and the second tabs 40*b*. To assemble the retainer 48 into the circumferential channel 46, the retainer 48 is compressed using radially inwardly projecting hooks 48*a*. The retainer 48 is compressed to a size that is diametrically smaller than the circumferential channel 46. The compressed retainer 48 is then inserted into the circumferential channel 46 and released such that the retainer expands into the circumferential channel 46. Since the retainer 48 is diametrically larger than the circumferential channel 46, the retainer 48 exerts a positive force in a radially outward direction, thus ensuring that the retainer 48 stays in the circumferential channel 46 to lock the first tabs 40*a* and the second tabs 40*b* together. Similarly, the hooks 48*a* can also be used to remove the retainer 48 from the circumferential channel 46 for maintenance or the like.

In a further example, the first rotor 26*a* and the second rotor 26*b* each include a number N of airfoils 70, shown in part in FIG. 2. Further, the first rotor 26*a* and the second rotor 26*b* each include a number (T) of the first tabs 40*a* and the second tabs 40*b*. The number N of the airfoils 70 and the number T of the tabs 40*a*/40*b* is selected such that N is a positive integer multiple of T. In other words, the number T of the first tabs 40*a* multiplied by the positive integer multiple equals the number N of airfoils 70 mounted on the first rotor 26*a*. Likewise, the number T of the second tabs 40*b* on the second rotor 26*b* multiplied by the positive integer multiple equals the number T of airfoils 70 mounted on the second rotor 26*b*.

Selecting the number N to be the positive integer multiple of the number T ensures that the rotors 26*a*/26*b* are balanced with regard to the stress generated on each of the tabs 40*a*/40*b*. Further, the positive integer multiple also ensures that the tabs 40*a*/40*b* are clocked to the position of the airfoils 70. For instance, in one example where the positive integer multiple is 2, there would be one tab 40*a* or 40*b* per two airfoils 70 on the respective first rotor 26*a* or second rotor 26*b*. Additionally, the positive integer multiple of 2 facilitates selection of a proper size of the tabs to carry the torque between the first rotor 26*a* and the second rotor 26*b*. For instance, a relatively larger number of tabs 40*a*/40*b* would require a relatively small individual cross-sectional tab area and corresponding relatively low strength. On the other hand, for a relatively small number of the tabs 40*a*/40*b* would require a relatively greater cross-sectional tab area and a corresponding greater strength, but at a weight penalty. The positive integer multiple of 2 provides a desirable balance between the stress that each tab would see in operation and size of the tabs to accommodate those stresses.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A rotor assembly comprising:

a first rotor including first tabs;

a second rotor arranged coaxially rotor and including second tabs that are interlocked with the first tabs; and a retainer locking the first tabs and the second tabs together, wherein the first rotor and the second rotor each include a number (N) of airfoils, and the first rotor and the second rotor each include a number (T) of, respectively, the first tabs and the second tabs such that N is a positive integer multiple of T.

2. The rotor assembly as recited in claim 1, wherein each of the first tabs and each of the second tabs includes a base and a free end and extends radially inwardly from the base to the free end.

3. The rotor assembly as recited in claim 1, wherein the first tabs and the second tabs define a circumferential channel.

4. The rotor assembly as recited in claim 3, wherein the circumferential channel opens in a radially inward direction.

5. The rotor assembly as recited in claim 3, wherein the retainer is located in the circumferential channel.

6. The rotor assembly as recited in claim 5, wherein the retainer is a split ring.

7. The rotor assembly as recited in claim 1, wherein the retainer is a positive engagement member.

8. The rotor assembly as recited in claim 7, wherein the positive engagement member is a split ring.

9. The rotor assembly as recited in claim 1, wherein the positive integer multiple is 2.

10. The rotor assembly as recited in claim 1, wherein the second tabs are circumferentially interlocked with the first tabs.

11. The rotor assembly as recited in claim 1, wherein the first rotor includes a first projection extending axially and located radially outwards of the first tabs and the second rotor includes a second projection extending axially and located radially outwards of the second tabs, the second projection axially overlapping the first projection and radially bearing against the first projection.

12. A rotor assembly comprising:

a first rotor including first tabs;

a second rotor arranged coaxially with the first rotor and including second tabs that are interlocked with the first tabs; and a retainer locking the first tabs and the second tabs together, wherein the retainer is a positive engagement member that is a split ring, and the split ring includes radially inwardly projecting hooks.

13. A turbomachine comprising:

a compressor section; and a turbine section coupled to rotate with the compressor section, the turbine section including a forward rotor having first hooked tabs, an aft rotor arranged coaxially with the forward rotor and having second hooked tabs that circumferentially interlock with the first hooked tabs, and a retainer coupling the first hooked tabs and the second hooked tabs together.

14. The turbomachine as recited in claim 13, wherein each of the first hooked tabs and each of the second hooked tabs includes a base and a free end and extends radially inwardly from the base to the free end.

15. The turbomachine as recited in claim 13, wherein the first hooked tabs and the second hooked tabs define a circumferential channel that opens in a radially inward direction, and the retainer is located in the circumferential channel.

16. The turbomachine as recited in claim 13, wherein the compressor section includes a compressor rotor, and the compressor rotor, the forward rotor and the aft rotor are axially held together by a tie rod.

17. The turbomachine as recited in claim 13, wherein tips of the first hooked tabs of the forward rotor are axially aft of tips of the second hooked tabs of the aft rotor such that there is a circumferential channel axially between the tips of the first hooked tabs and the tips of the second hooked tabs, and the retainer is situated in the circumferential channel.

18. A method of coupling a first rotor and a second rotor together, the method comprising:

interlocking first tabs of a first rotor with second tabs of a second rotor that is arranged coaxially with the first rotor; and locking the first tabs and the second tabs together using a retainer, wherein the first rotor and the second rotor each include a number (N) of airfoils, and the first rotor and the second rotor each include a number (I) of, respectively, the first tabs and the second tabs such that N is a positive integer multiple of T.

19. The method as recited in claim 18, wherein the interlocking of the first tabs with the second tabs includes establishing a circumferential channel that opens in a radially inward direction.

20. The method as recited in claim 19, wherein the locking of the first tabs and the second tabs together includes inserting the retainer into the circumferential channel.

* * * * *

UNITED STATES PATENT AND TRADEMARK OFFICE

CERTIFICATE OF CORRECTION

PATENT NO. : 9,109,450 B2
APPLICATION NO. : 13/523272
DATED : August 18, 2015
INVENTOR(S) : Raymond S. Hummel It is certified that error appears in the above-identified patent and that said Letters Patent is hereby corrected as shown below:

IN THE CLAIMS:

In claim 1, column 5, line 4; after "coaxially" insert --with the first--

In claim 18, column 6, line 37; delete "(I)" and replace with --(T)--

Signed and Sealed this
Fifth Day of January, 2016

Michelle K. Lee

Michelle K. Lee
*Director of the United States Patent and Trademark Office*